US007309963B2

(12) United States Patent
Busse et al.

(10) Patent No.: US 7,309,963 B2
(45) Date of Patent: Dec. 18, 2007

(54) SMOOTHING CIRCUIT FOR IMPROVING EMC

(75) Inventors: Olaf Busse, München (DE); Markus Heckmann, München (DE); Reinhard Lecheler, Neuburg/Donau (DE); Alfons Lechner, Hohenwart (DE); Siegfried Mayer, Moosinning (DE); Thomas Pollischansky, Stadtbergen (DE); Bernd Rudolph, Forstern (DE); Bernhard Schemmel, Wessling (DE); Kay Schmidtmann, München (DE); Harald Schmitt, München (DE); Thomas Siegmund, Otterfing (DE); Arwed Storm, Dachau (DE); Horst Werni, München (DE)

(73) Assignee: Patent-Treuhand-Gesellschaft für elektrische Glühlampen mbH, Munich (DE)

( * ) Notice: Subject to any disclaimer, the term of this patent is extended or adjusted under 35 U.S.C. 154(b) by 51 days.

(21) Appl. No.: 11/455,796

(22) Filed: Jun. 20, 2006

(65) Prior Publication Data

US 2006/0284572 A1 Dec. 21, 2006

(30) Foreign Application Priority Data

Jun. 21, 2005 (DE) ..... 10 2005 028 672

(51) Int. Cl.
*H05B 41/36* (2006.01)

(52) U.S. Cl. ..... 315/307; 315/291; 315/224

(58) Field of Classification Search ..... 315/209 R, 315/224–226, 244, 276, 291, 307, 308
See application file for complete search history.

(56) References Cited

U.S. PATENT DOCUMENTS

| | | | | |
|---|---|---|---|---|
| 5,925,984 | A * | 7/1999 | Fischer et al. | 315/219 |
| 6,426,597 | B2 * | 7/2002 | Rast et al. | 315/219 |
| 6,744,220 | B2 * | 6/2004 | Neidlinger | 315/244 |
| 6,876,158 | B2 * | 4/2005 | Trostl et al. | 315/291 |
| 2002/0047602 | A1 | 4/2002 | Franck et al. | 315/224 |

FOREIGN PATENT DOCUMENTS

DE 10 2005 028 672.0 6/2005

* cited by examiner

*Primary Examiner*—Douglas W. Owens
*Assistant Examiner*—Jimmy Vu
(74) *Attorney, Agent, or Firm*—Carlo S. Bessone

(57) ABSTRACT

The present invention relates to an electronic ballast for discharge lamps, for example low-pressure discharge lamps, having a converter having a switching element and a two-part lamp inductor which is connected upstream and downstream of the discharge lamp. An electronic ballast according to the invention has a smoothing circuit which reduces voltage jumps caused by switching operations in the converter at the lamp terminals.

19 Claims, 2 Drawing Sheets

SMOOTHING CIRCUIT FOR IMPROVING EMC

TECHNICAL FIELD

The present invention relates to an electronic ballast for discharge lamps, for example low-pressure discharge lamps, having a converter having a switching element.

PRIOR ART

Electronic ballasts for operating discharge lamps are known in various embodiments. They generally contain a converter which drives the discharge lamp. In principle, a converter produces a supply voltage for the discharge lamp to be operated using a radiofrequency current from a rectified AC voltage supply or a DC voltage supply. Converters generally produce this radiofrequency AC voltage via switching elements which operate in opposition. The AC supply is then applied between an AC output of the converter and one of the supply potential lines of the converter.

Lamp terminals required for connecting the lamp are connected between the AC output and one of the supply potential lines of the converter. A lamp inductor is normally connected in series with the lamp terminals.

The laid-open specification DE 100 36 952 A1 describes a circuit arrangement in which the lamp inductor is not implemented by a single inductance, but is split into two lamp inductors. One lamp inductor is connected between the AC output of the converter and the lamp terminal on the AC-output side. The other lamp inductor is connected between the terminal on the supply-potential side and the corresponding supply potential line. These two lamp inductors are coupled to one another via a common core. In this manner, the potential of at least one lamp terminal can be reduced in comparison with the ground potential.

SUMMARY OF THE INVENTION

The invention is based on the technical problem of specifying an improved electronic ballast having a split lamp inductor.

The invention relates to an electronic ballast for a discharge lamp having a converter, which has a switching element and an AC output for the AC supply to the discharge lamp, two lamp terminals via which the discharge lamp can be connected between the AC output and one of the supply potentials of the converter, in each case one lamp inductor being connected between one of the lamp terminals, which is on the AC-output side, and the AC output, on the one hand, and between one of the lamp terminals, which is on the supply-potential side, and the supply potential, on the other hand, characterized by a smoothing circuit, which has a series circuit comprising a smoothing capacitor and a decoupling component, said series circuit being connected between the AC output and one of the supply potentials of the converter, the decoupling component being connected in series with the lamp terminals, and the smoothing capacitor being connected between a connection node between the decoupling component and the lamp inductor on the AC-output side and one of the supply potentials of the converter or in parallel with the series circuit comprising the lamp inductors and the lamp terminals, with the result that voltage jumps caused by the switching elements switching are reduced at the lamp terminals.

The invention is based on the knowledge that the switching operations in the converter are expressed in the form of radiofrequency voltage jumps at the AC output. These voltage jumps at the AC output drive the oscillation of the lamp resonant circuit comprising the lamp inductor, the discharge lamp, a coupling capacitor and a resonant capacitor, which lamp resonant circuit is connected between the AC output and one of the supply potentials of the converter. Circuit arrangements in accordance with the remaining prior art merely have a single-part lamp inductor, which is connected in series with the AC output, represents a high impedance for the voltage jumps and largely decouples the oscillation of the lamp resonant circuit from the voltage jumps at the AC output in terms of radiofrequency. In the case of a lamp inductor which is split and is connected upstream and downstream of the lamp terminals, the individual inductances, however, act as a voltage divider for radiofrequency voltage components. A voltage profile which still has considerable jumps having radiofrequency components is thus applied to the lamp terminals.

The smoothing circuit according to the invention smoothes these voltage jumps at the lamp terminals. The smoothing circuit comprising a series circuit comprising a smoothing capacitor and a decoupling component can be incorporated in the electronic ballast in various ways. The decoupling component is always connected in series with the series circuit comprising the lamp inductors and the lamp terminals. There are three possibilities for the connection of the smoothing capacitor. These three possibilities have a common factor in that one side of the smoothing capacitor is connected to the connection node between the decoupling component and the lamp inductor on the AC-output side, and the other side of the smoothing capacitor is connected to a potential which is quiescent with respect to the radiofrequency components of the AC voltage produced by the converter. The smoothing capacitor can be connected in parallel with the series circuit comprising the lamp inductors and the lamp terminals—this is claimed by independent claim 1—and in the process can be connected directly to the corresponding supply potential of the converter or else to a connection node between the lamp inductor on the supply-potential side and a decoupling capacitor—claimed by dependent claim 2.

Independent claim 3 claims circuit arrangements in which the smoothing capacitor is connected to one of the supply potentials of the converter. The specific case in which the smoothing capacitor is connected to the supply potential of the converter, which is not also the supply potential of the lamp, is claimed by dependent claim 4. The two independent claims 1 and 3 overlap one another, to be precise in both cases the smoothing capacitor can be connected in parallel with a series circuit comprising the lamp inductors, the lamp terminals and the coupling capacitor; this overlap is claimed separately by dependent claim 5.

In each case one resistor can be connected in series with the smoothing capacitor, for example in order to provide an additional possibility for establishing an appropriate time constant from the capacitance of the smoothing capacitor and the nonreactive resistance.

The decoupling component decouples the smoothing capacitor from the AC output, with the result that it does not act, in an undesirable manner, as a so-called trapezoidal capacitor, which directly changes the output voltage profile.

In one preferred embodiment of the invention, the two lamp inductors are coupled to one another, for example, via a common core. Given suitable dimensions for the lamp inductors and suitable coupling, the radiofrequency AC voltages at the lamp terminals can be balanced, i.e. the radiofrequency AC voltages at the lamp terminals can then be phase-shifted through 180°. In addition, the potential with respect to ground can be reduced at at least one of the lamp terminals. These measures make it possible to improve electromagnetic compatibility, in which regard reference is made to the above-cited laid-open specification DE 100 36 952 A1.

The two lamp inductors preferably have inductances of the same order of magnitude. In one preferred embodiment of the invention, the smaller of the two inductances corresponds to at least 30% of the inductance of the other lamp inductor. Preferred embodiments of the invention have an inductance for one of the two lamp inductors which corresponds to at least 40%, 47% and 50% of the inductance of the other lamp inductor. These figures are increasingly preferred in the sequence provided. The closer the inductances of the two lamp inductors are to one another, the better the AC voltages at the lamp terminals are balanced.

In one alternative to the latter embodiment, the two lamp inductors have inductances of a different order of magnitude. The lamp inductor with the greater inductance is in this case connected between the lamp terminal on the AC side and the AC output of the converter. The smaller of the two inductances in this case preferably corresponds to at most 5%, particularly preferably at most 4% or 3% of the inductance of the other lamp inductor. These figures are increasingly preferred in the sequence provided.

The last two alternative embodiments of the invention correspond to a different weighting for the respectively positive and negative properties of the two embodiments. If the two lamp inductors have inductances of the same order of magnitude, largely perfect balancing can be achieved. The voltage jumps to be smoothed by the smoothing circuit according to the invention at the lamp terminals are, however, comparatively large and may not be sufficiently smoothed for the respective application. If the two lamp inductors have inductances of a different order of magnitude, the voltages applied to the lamp terminals are hardly balanced. The voltage jumps at the lamp terminals are, however, comparatively small, with the result that they can be largely or completely smoothed in combination with the smoothing circuit. A corresponding decision relating to the design depends, inter alia, on other components in the electronic ballast, for example on the properties of any electronic filters which may be present.

The decoupling component is preferably an inductance. In comparison with a nonreactive resistor as the decoupling element, an inductance has the advantage that it does not cause any considerable ohmic losses and, nevertheless, decouples very effectively in the radiofrequency range.

The converter is preferably a half-bridge circuit having two switching elements, the AC output being the center tap between the switching elements. Such an embodiment of the invention can be implemented in a particularly simple manner.

BRIEF DESCRIPTION OF THE DRAWINGS

The invention will be explained in more detail below with reference to an exemplary embodiment. The individual features disclosed therein may also be essential to the invention in other combinations. The description above and below relates to the apparatus aspect and the method aspect of the invention, without explicit mention of this being made in detail.

PREFERRED EMBODIMENT OF THE INVENTION

Figure 1:
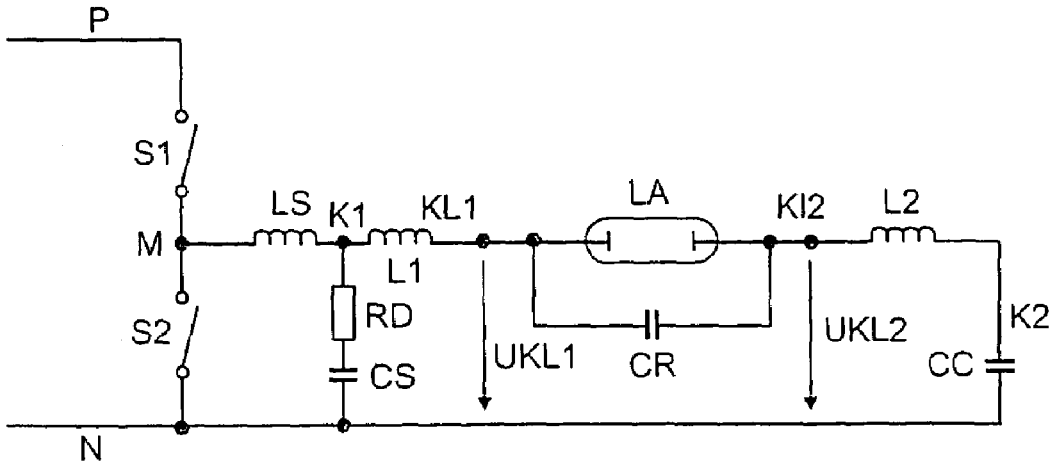
FIG. 1 shows a first circuit arrangement according to the invention. This can be designed as part of an electronic ballast according to the invention.

FIG. 1 shows a circuit arrangement according to the invention as part of an electronic ballast according to the invention.

FIG. 1 shows a converter, in the form of a half-bridge circuit, which has two switching elements S1 and S2 and is connected between two supply potential lines N and P. An AC output M, i.e. a center tap M, is positioned between the two switching elements S1 and S2. The switching elements S1 and S2 may be in the form of MOSFETs. A series circuit comprising a lamp inductor L1 on the center-tap side, a lamp terminal KL1, a low-pressure discharge lamp LA, a lamp terminal KL2 on the supply-potential side, a lamp inductor L2 on the supply-potential side and a coupling capacitor CC is connected between the center tap M and the supply potential line N of the converter S1, S2. A resonant capacitor CR is connected in parallel with the low-pressure discharge lamp LA, connected between the lamp inductors L1 and L2. The two lamp inductors L1 and L2, each having the same inductance, are coupled to one another via a common core K. In this manner, the voltages UKL1 and UKL2 at the lamp terminals KL1 and KL2 are balanced, i.e. the lamp terminal potentials are in phase opposition in relation to the supply potential N of the converter S1, S2. Electromagnetic radiation can thus be reduced.

The electronic ballast according to the invention has a smoothing circuit comprising a series circuit comprising a decoupling inductance LS, a resistor RD and a smoothing capacitor CS. The decoupling inductance LS is connected between the center tap M and the lamp inductor L1 on the center-tap side. The series circuit comprising the resistor RD and the smoothing capacitor CS is connected at the connection node between the decoupling inductance LS and the lamp inductor L1 on the center-tap side, toward the supply potential N of the converter.

Figure 2:
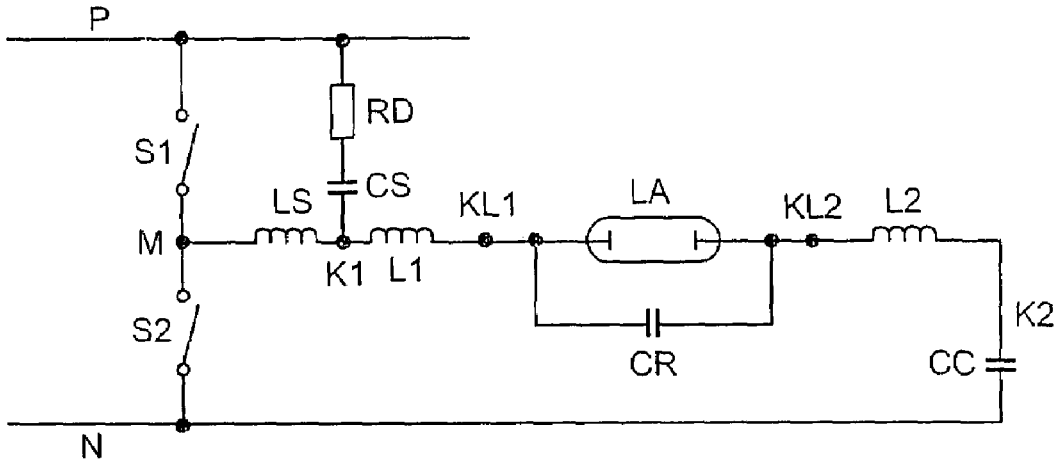
FIG. 2 shows a variation of the circuit arrangement from FIG. 1 as a second exemplary embodiment.
Figure 3:
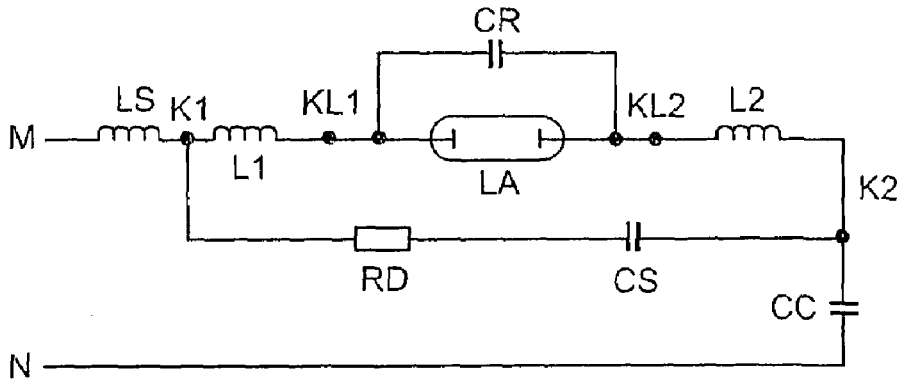
FIG. 3 shows a second variation of the circuit arrangement from FIG. 1 as a third exemplary embodiment.

FIGS. 2 and 3 show alternative wiring possibilities to the circuit arrangement shown in FIG. 1, as second and third exemplary embodiments. The same references are used as previously.

In contrast to the circuit arrangement shown in FIG. 1, in the circuit arrangement shown in FIG. 2 the series circuit comprising the resistor RD and the smoothing capacitor CS is connected to the supply potential P of the converter and not to the supply potential N.

In FIG. 3, the smoothing capacitor CS is connected on the supply-potential side to a node K2 between the coupling capacitor CC and the lamp inductor L2 on the supply-potential side.

Figure 4:
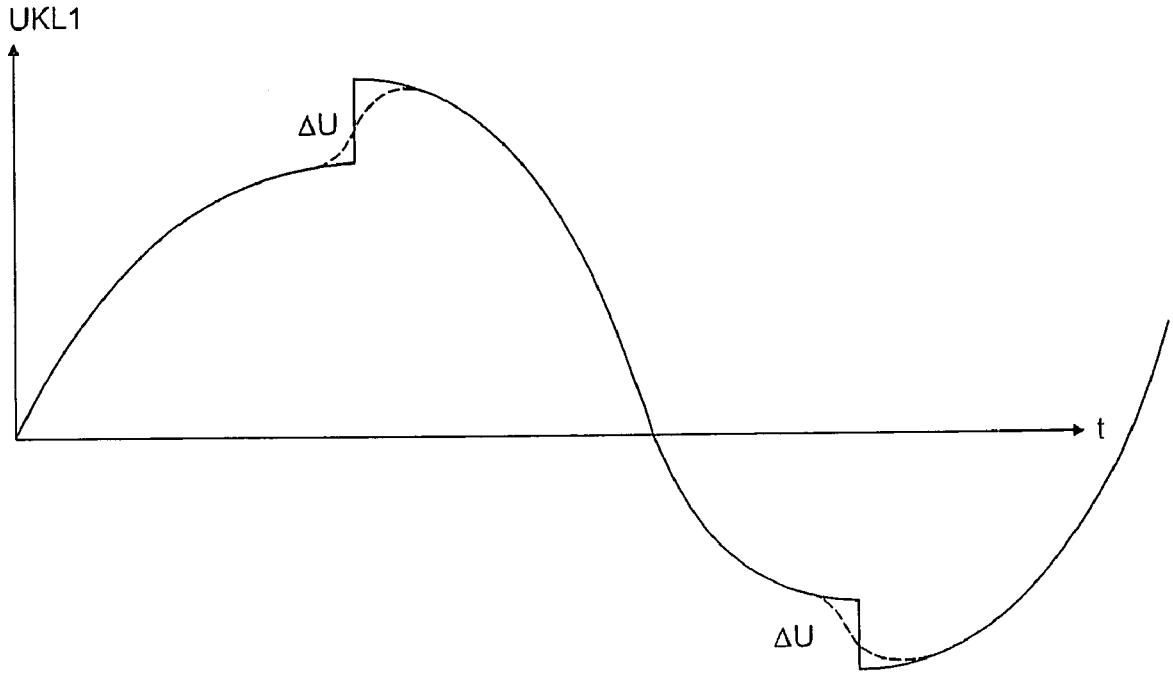
FIG. 4 shows a schematic graph of the AC voltage UKL1 at a lamp terminal KL1 as a function of time.

FIG. 4 shows the radiofrequency AC voltage UKL1 at one of the lamp terminals KL1 as a function of time t for all of the above exemplary embodiments. The voltage UKL2 at the lamp terminal KL2 shows the same response, but the profile over time is phase-shifted with respect to the voltage UKL1 at the lamp terminal KL1.

The continuous line shows the oscillation of the lamp resonant circuit which is driven by the radiofrequency switching of the switching elements S1 and S2 in the converter. The two lamp inductors L1 and L2 act as a voltage divider for the voltage jumps applied to the center tap M, with the result that voltage jumps are likewise applied to the lamp terminals KL1 and KL2. The continuous line shows these voltage jumps having the level ΔU. The dashed line shows the effect of the smoothing circuit LS, RD, CS on these voltage jumps. The AC voltage supply to the lamp terminal KL1 shows a much smoother profile; high frequencies which have a negative effect on the electromagnetic compatibility are filtered out.

Yet another alternative exemplary embodiment will be presented: the inductances of the two lamp inductors L1 and L2 are selected to be different; the smaller of the two inductances L2 corresponds to 2% of the greater inductance L1. The greater L1 of the two inductances L1, L2 is in this case connected between the lamp terminal KL1 on the AC-output side and the AC output M. The voltages UKL1 and UKL2 at the lamp terminals are then only weakly balanced, but the voltage jumps ΔU at the lamp terminals KL1 and KL2 which are to be smoothed by the smoothing circuit are in this case relatively small. An appropriate decision in relation to the design depends on the other properties of the circuit of the electronic ballast, for example filter properties in specific frequency ranges, which can be addressed by appropriately selecting the inductances L1 and L2.

The invention claimed is:

1. An electronic ballast for a discharge lamp (LA) having:

a converter, which has a switching element (S1, S2) and an AC output (M) for the AC supply to the discharge lamp (LA), two lamp terminals (KL1, KL2), via which the discharge lamp (LA) can be connected between the AC output (M) and one of the supply potentials (N, P) of the converter (S1, S2), in each case one lamp inductor (L1, L2) being connected between one of the lamp terminals (KL1), which is on the AC-output side, and the AC output (M), on the one hand, and between one of the lamp terminals (KL2), which is on the supply-potential side, and the supply potential (N, P), on the other hand, characterized by a smoothing circuit (LS, RD, CS), which has a series circuit (CS, RD, LS) comprising a smoothing capacitor (CS) and a decoupling component (LS), said series circuit being connected between the AC output (M) and one of the supply potentials (N, P) of the converter (S1, S2), the smoothing capacitor (CS) being connected in parallel with, and the decoupling component (LS) being connected in series with, the series circuit comprising the lamp inductors (L1, L2) and the lamp terminals (KL1, KL2), with the result that voltage jumps (ΔU) caused by the switching elements (S1, S2) switching are reduced at the lamp terminals (KL1, KL2).

2. The electronic ballast as claimed in claim 1, which has a coupling capacitor (CC), which is connected between the lamp inductor (L2) on the supply-potential side and one of the supply potentials (N), and in which the smoothing capacitor (CS) is connected on the supply-potential side to a connection node (K2) between the lamp inductor (L2) on the supply-potential side and the coupling capacitor (CC).

3. The electronic ballast as claimed in claim 1, which has a coupling capacitor (CC) which is connected between the lamp inductor (L2) on the supply-potential side and one of the supply potentials (N), and in which the smoothing capacitor (CS) is connected in parallel with the series circuit comprising the lamp inductors (L1, L2), the lamp terminals (KL1, KL2) and the coupling capacitor (CC).

4. The electronic ballast as claimed in claim 1, in which the lamp inductors (L1, L2) are coupled to one another.

5. The electronic ballast as claimed in claim 1, in which the smaller of the two lamp inductors (L1, L2) has at least 30% of the inductance of the respective other lamp inductor (L1, L2).

6. The electronic ballast as claimed in claim 1, in which the smaller of the two lamp inductors (L1, L2) has at most 5% of the inductance of the other lamp inductor (L1, L2), and the larger of the two lamp inductors (L1, L2) is connected between the AC output (M) and the lamp terminal (KL1) on the AC-output side.

7. The electronic ballast as claimed in claim 1, in which the decoupling component (LS) is an inductance.

8. The electronic ballast as claimed in claim 1, in which the converter (S1, S2) is a half-bridge circuit (S1, S2) having two switching elements (S1, S2), and the AC output (M) is the center tap (M) between the switching elements (S1, S2).

9. The electronic ballast as claimed in claim 1, designed for operating a low-pressure discharge lamp (LA).

10. A set comprising an electronic ballast as claimed in claim 1 and a discharge lamp (LA) which is suitable for operation using this ballast.

11. An electronic ballast for a discharge lamp (LA) having:

a converter, which has a switching element (S1, S2) and an AC output (M) for the AC supply to the discharge lamp (LA), two lamp terminals (KL1, KL2), via which the discharge lamp (LA) can be connected between the AC output (M) and one of the supply potentials (N, P) of the converter (S1, S2), in each case one lamp inductor (L1, L2) being connected between one of the lamp terminals (KL1), which is on the AC-output side, and the AC output (M), on the one hand, and between one of the lamp terminals (KL2), which is on the supply-potential side, and the supply potential (N, P), on the other hand, characterized by a smoothing circuit (LS, RD, CS), which has a series circuit (CS, RD, LS) comprising a smoothing capacitor (CS) and a decoupling component (LS), said series circuit being connected between the AC output (M) and one of the supply potentials (N, P) of the converter (S1, S2), the decoupling component (LS) being connected in series with the lamp terminals (KL1, KL2), and the smoothing capacitor (CS) being connected between a connection node (K1) between the decoupling component (LS) and the lamp inductor (L1) on the AC-output side (M) and one of the supply potentials (N, P) of the converter (S1, S2), with the result that voltage jumps (ΔU) caused by the switching elements (S1, S2) switching are reduced at the lamp terminals (KL1, KL2).

12. The electronic ballast as claimed in claim 11, which has a coupling capacitor (CC) which is connected between the lamp inductor (L2) on the supply-potential side and one of the supply potentials (N), and in which the smoothing capacitor (CS) is connected on the supply-potential side to the other supply potential (P).

13. The electronic ballast as claimed in claim 11, which has a coupling capacitor (CC) which is connected between the lamp inductor (L2) on the supply-potential side and one of the supply potentials (N), and in which the smoothing capacitor (CS) is connected in parallel with the series circuit comprising the lamp inductors (L1, L2), the lamp terminals (KL1, KL2) and the coupling capacitor (CC).

14. The electronic ballast as claimed in claim 11, in which the lamp inductors (L1, L2) are coupled to one another.

15. The electronic ballast as claimed in claim 11, in which the smaller of the two lamp inductors (L1, L2) has at least 30% of the inductance of the respective other lamp inductor (L1, L2).

16. The electronic ballast as claimed in claim 11, in which the smaller of the two lamp inductors (L1, L2) has at most 5% of the inductance of the other lamp inductor (L1, L2), and the larger of the two lamp inductors (L1, L2) is connected between the AC output (M) and the lamp terminal (KL1) on the AC-output side.

17. The electronic ballast as claimed in claim 11, in which the decoupling component (LS) is an inductance.

18. A method for operating an electronic ballast for a discharge lamp (LA), in which a converter, which has a switching element (S1, S2) and an AC output (M), supplies alternating current to the discharge lamp (LA), the discharge lamp (LA) is connected between the AC output (M) and one of the supply potentials (N, P) of the converter (S1, S2) via two lamp terminals (KL1, KL2), in each case one lamp inductor (L1, L2) is connected between one of the lamp terminals (KL1), which is on the AC-output side, and the AC output (M), on the one hand, and between one of the lamp terminals (KL2), which is on the supply-potential side, and the supply potential (N, P), on the other hand, characterized by a smoothing circuit (LS, RD, CS), which has a series circuit (CS, RD, LS) comprising a smoothing capacitor (CS) and a decoupling component (LS), said series circuit being connected between the AC output (M) and one of the supply potentials (N, P) of the converter (S1, S2), the smoothing capacitor (CS) being connected in parallel with, and the decoupling component (LS) being connected in series with, the series circuit comprising the lamp inductors (L1, L2) and the lamp terminals (KL1, KL2), in which case voltage jumps (ΔU) caused by the switching elements (S1, S2) switching are reduced at the lamp terminals (KL1, KL2) by the smoothing circuit (LS, RD, CS).

19. A method for operating an electronic ballast for a discharge lamp (LA), in which a converter, which has a switching element (S1, S2) and an AC output (M), supplies alternating current to the discharge lamp (LA), the discharge lamp (LA) is connected between the AC output (M) and one of the supply potentials (N, P) of the converter (S1, S2) via two lamp terminals (KL1, KL2), in each case one lamp inductor (L1, L2) is connected between one of the lamp terminals (KL1), which is on the AC-output side, and the AC output (M), on the one hand, and between one of the lamp terminals (KL2), which is on the supply-potential side, and the supply potential (N, P), on the other hand, characterized by a smoothing circuit (LS, RD, CS), which has a series circuit (CS, RD, LS) comprising a smoothing capacitor (CS) and a decoupling component (LS), said series circuit being connected between the AC output (M) and one of the supply potentials (N, P) of the converter (S1, S2), the decoupling component (LS) being connected in series with the terminals (KL1, KL2), and the smoothing capacitor (CS) being connected between a connection node (1(1) between the decoupling component (LS) and the lamp inductor (L1) on the AC-output side (M) and one of the supply potentials (N, P) of the converter (S1, S2), in which case voltage jumps (ΔU) caused by the switching elements (S1, S2) switching are reduced at the lamp terminals (KL1, KL2) by the smoothing circuit (LS, RD, CS).

* * * * *